United States Patent [19]

Szego et al.

[11] 4,144,624

[45] Mar. 20, 1979

[54] MACHINE FOR EXPANDING METAL WEBS

[75] Inventors: Andrew Szego; Victor Kallay, both of Toronto, Canada

[73] Assignee: Explosafe America Inc., Rexdale, Canada

[21] Appl. No.: 829,284

[22] Filed: Aug. 31, 1977

[30] Foreign Application Priority Data

Sep. 2, 1976 [GB] United Kingdom ..... 36391/76
Sep. 2, 1976 [GB] United Kingdom ..... 36392/76

[51] Int. Cl.[2] ..... B21D 31/04; B21D 47/02

[52] U.S. Cl. ..... 29/6.1

[58] Field of Search ..... 29/6.1; 113/116 A; 72/183, 395

[56] References Cited

U.S. PATENT DOCUMENTS

| | | | |
|---|---|---|---|
| Re. 16,504 | 12/1926 | Salmon et al. | 29/6.1 |
| 670,606 | 3/1901 | Curtis | 29/6.1 |
| 796,402 | 8/1905 | Curtis | 29/6.1 |
| 845,764 | 3/1907 | Curtis | 83/303 |
| 917,715 | 4/1909 | Curtis | 29/6.1 |
| 1,207,716 | 12/1916 | Curtis | 29/6.1 |
| 1,412,434 | 4/1922 | Weightman | 29/6.1 |
| 1,417,706 | 5/1922 | White | 29/6.1 |
| 1,436,554 | 11/1922 | Weightman | 29/6.1 |
| 1,493,965 | 5/1924 | Curtis et al. | 29/6.1 |
| 1,509,543 | 9/1924 | Curtis | 29/6.1 |
| 1,545,192 | 7/1925 | Lentz | 29/6.1 |
| 1,818,246 | 8/1931 | Galbreath | 29/6.1 |
| 1,852,636 | 4/1932 | Arey | 29/6.1 |
| 2,046,621 | 7/1936 | Gibson | 29/6.1 |
| 2,106,967 | 8/1934 | Cross | 29/6.1 |
| 3,162,231 | 12/1964 | Emerson | 72/191 |

*Primary Examiner*—Horace M. Culver
*Attorney, Agent, or Firm*—Ridout & Maybee

[57] ABSTRACT

An expander machine for expanding rotary slit metal webs is of the type having mutually inclined triangular expander arms over which the web is passed forwardly to spread the web and open out the slits to form diamond-shaped meshes. The angle between the arms is made adjustable, and the arms are mounted on a sub-frame which pivots about a longitudinal axis so that when the angle between the arms is adjusted it is possible by tilting the sub-frame to restore the output of expanded web to the horizontal plane. The horizontal delivery of the expanded web facilitates subsequent processing and reduces the risk of damaging frail expanded webs e.g. thin metal foil webs. Advantageous arrangements for gripping the edges of the web and conveying it are disclosed.

18 Claims, 20 Drawing Figures

MACHINE FOR EXPANDING METAL WEBS

BACKGROUND OF THE INVENTION

The present invention relates to improvements in expander machines for forming open-mesh expanded material from webs which have beforehand been slit on a rotary slitting machine so as to provide them with an array of parallel discontinuous slit lines. More especially, the machine is intended for production of expanded aluminium meshes for use as explosion-suppressive fillings such as are described in British Pat. No. 1,131,687 dated Oct. 18, 1966, in the name of Joseph Szego, although it may be employed in the production of other kinds of expanded materials.

A known form of expander machine for expanding rotary slit webs comprises a pair of expander arms with vertically and horizontally diverging edges along which the slit web is passed, the web slipping laterally over the diverging edges and being spread therebetween so as to open the slits in the web out into diamond-shaped meshes. The known form of machine is, however, subject to numerous disadvantages which we have now overcome and these are described in greater detail hereinafter.

SUMMARY OF THE INVENTION

In one aspect of the invention, we support the expander arms of an expander machine by mounting them on a sub-frame through adjustable connections allowing the angle between the edges of the arms to be widened or diminished, and the sub-frame is mounted on a main frame through further adjustable connections allowing the sub-frame to be tilted about a pivotal axis extending longitudinally of the direction of web fed on the expander arms. This allows the angle between the expander arms to be adjusted to varying angles of inclination as may be necessary to obtain expanded meshes of a desired mesh configuration, while allowing the expanded output web from the machine to be supplied in a horizontal plane by tilting the main frame of the machine as appropriate to one side or the other. For the purposes described in the above-mentioned patent, the expanded product may be laid in superimposed, contiguous layers to form a bale of metal mesh, and this operation, whether carried out by reeling the product up, folding it, or stacking separate sheets cut from the web, can most conveniently be carried out with the web being delivered in a horizontal plane. Further, if the output web of expanded product is inclined, it may tend to pull to one side or deform under the force of gravity, resulting in a bale of ill-defined shape and undesirably irregular density. By delivering the expanded web directly horizontally from the expander machine, the need for guides to restore the web to the horizontal is avoided, and this is particularly important where thin metal foils are used and the expanded webs are relatively frail and vulnerable to deformation.

Preferably, the tilting axis of the machine sub-frame extends centrally off the web feed on the expander arms, so that the line of travel of the output of expanded material does not shift when the sub-frame axis is tilted.

According to a further aspect of the present invention, we provide an expander machine with grippers for retaining and conveying the edges of the web in its travel along the expander arms, these grippers comprising a driven endless belt having a longitudinal groove and a driven endless blade member parallel to and pressing edgewise into the groove, the web edges being gripped in the said groove between the belt and the blade member. We have found that these gripper devices efficiently and reliably retain the edges of the web, and are particularly useful when expanding metal webs in the form of thin foils such as the foils of five to twelve thousandths of an inch thickness that we describe in our above-mentioned patent application. Whereas in the known expander machines the edges of the webs are typically retained by sets of driven gripping rollers arrayed along the length of the expander arms, we have found that these roller arrangements do not adequately support and retain the edges of thin foils, since inevitably there are gaps between the rollers and loss of gripping, deformation and tearing of the foil may occur at unsupported points. With our arrangement, the foil may be supported firmly and uniformly along the entire extent of its travel over the expander arms.

In a further aspect of the present invention, an expander machine includes supporting structure for rotatably mounting a coil of slit metal web material, and guide members are arranged between the coil supporting structure and the expander arms which feed the slit web directly to the arms. When expanding thin metal foils, we have found that the throughput speeds of the expander machines are necessarily limited because the relatively weak foils cannot withstand the stresses which are generated in high speed operation. The foils can, however, be slit at a much higher rate, and we have found that typically the foils may be slit at a throughput speed approximately three times the maximum expander speed. After slitting the foils, we therefore prefer to reel them up into slit coil stock and use the coil stock produced from a lesser number of slitter machines as the feed supply for a greater number of expander machines, thus increasing overall production rates.

Preferably, a guide for the web feed to the expander arms is in the form of a smooth bar non-rotatably supported between the coil-supporting structure and the expander arms, the web slipping around the bar, and the bar being inclined non-perpendicularly to the direction of web feed along the expander arms.

Preferably the axis of the bar is parallel to or aligned with the general plane of the web at its region of approach to the expander arms.

Where the expander arms are arranged so as to be adjustable in their angle of divergence and to be tiltable as a whole so as to maintain the output expanded web horizontal, this guide arrangement for the web feed avoids the need to tilt the input supply of slit web when the expander arms are tilted. Further, where the expander machine is fed from a coil of slit metal web, it avoids the need to move the heavy coil stock upwards and downwards against the force of gravity when the expander arms are tilted.

In another aspect of the present invention, we provide an expander machine with expander arms in the form of members demountably secured on respective support arms, the support arms being connected to the machine frame by means allowing them to be laterally adjusted towards or away from one another. This allows the machine to be adjusted to accommodate input webs of varying width. When adjustments are made in the spacing between the support arms, a replacement set of expander arm members can be substituted in the machine, to provide for satisfactory support of the web material at the entrance end of the expander arms.

With this arrangement, it is preferred to convey the metal web along the expander arms using an endless belt in gripping contact with the edges of the web. When a fresh set of expander arms are substituted in the machine, adjustment in the length of the gripping run of the belt which is necessary to insure that the web is released once it has been expanded to the desired extent can readily be achieved by adjusting the positions of pulleys around which the belt runs, or if necessary by substituting a belt of a different length, and the belt may conveniently be driven by transversely extending drive shafts which can readily be arranged so as to be adjustable laterally together with the support arms for the expander arms. This provides for a relatively simple adjustment procedure for setting up the machine to accommodate webs of differing widths.

In one preferred embodiment, which is especially adapted for expanded material of varying width, the surface of each expander arm on which the web is to be supported and over which the web slips as it moves through the machine, is made smooth-surfaced at least in a region extending forwardly from the rear of the arm and over a major part of its length, and the web is conveyed by being gripped at each edge between the smooth surface of the expander arm and a driven endless belt which runs along the expander arm and is pressed towards the said smooth surface.

We have found that this gripping arrangement efficiently and reliably retains the edges of the web, and is particularly useful when expanding metal webs in the form of thin foils such as the foils of five to twelve thousandths of an inch thickness that we describe in our above-mentioned patent application. Moreover, the belts can accommodate metal webs of varying widths.

BRIEF DESCRIPTION OF THE DRAWINGS

Expander machines embodying the various aspects of the present invention will now be more fully described, by way of example only, with reference to the accompanying drawings in which.

Figures 1, 2:
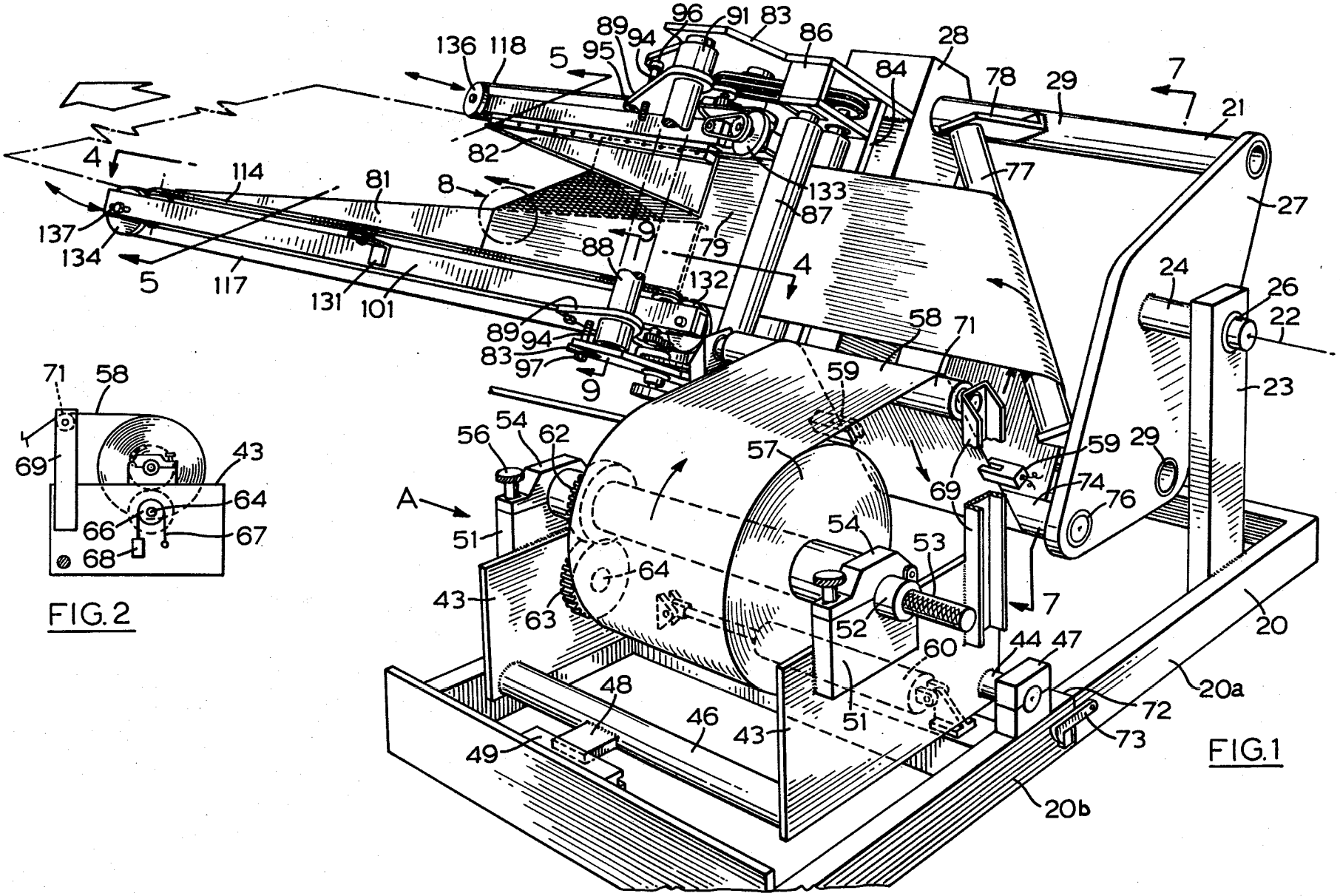
FIG. 1 shows a perspective view of a first embodiment of an expander machine.
FIG. 2 shows a side view of the coil stock holder of the machine viewed on the arrow A in FIG. 1.
Figure 11:
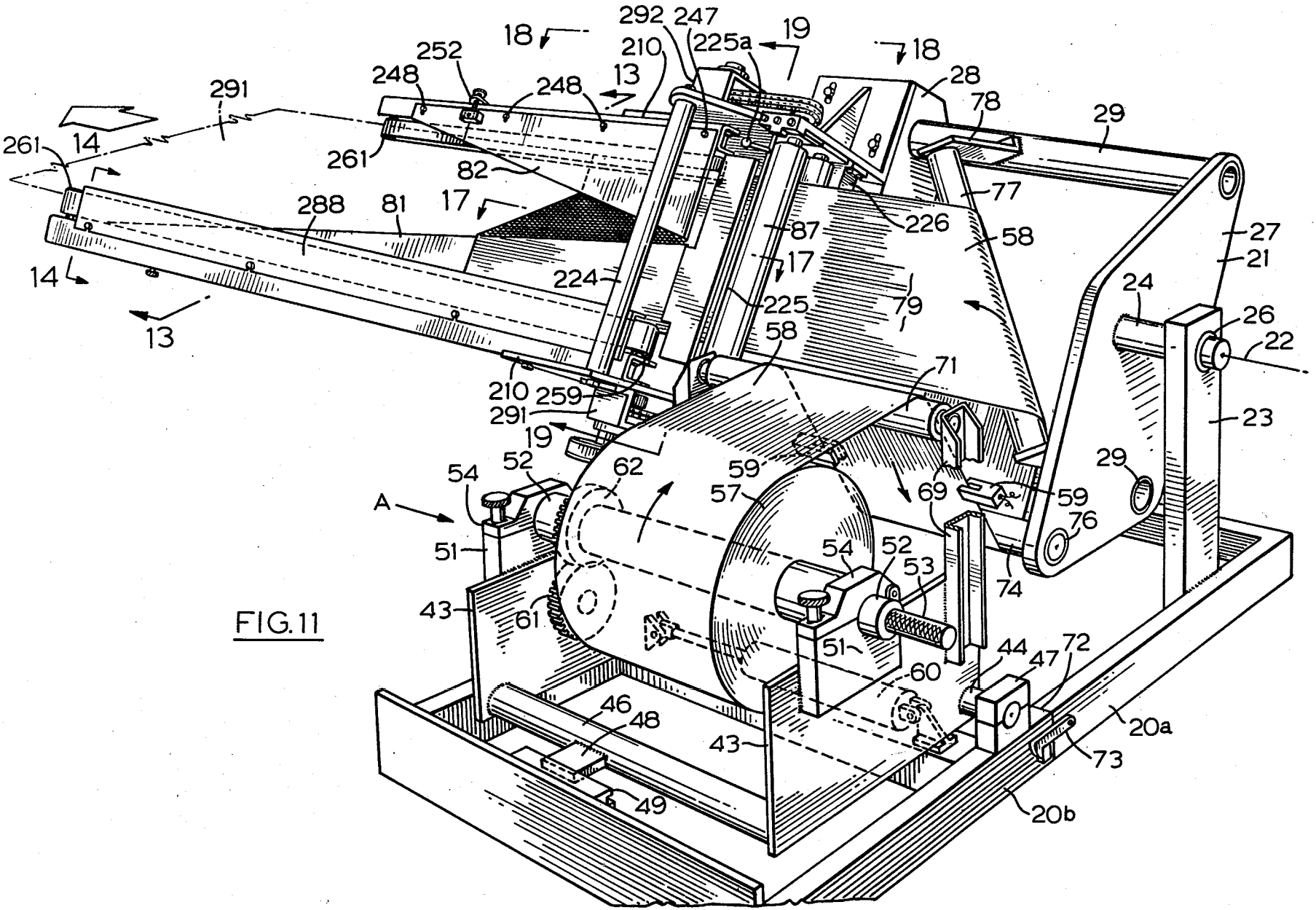
FIG. 11 shows a perspective view of an expander machine according to a second embodiment.
Figure 15:
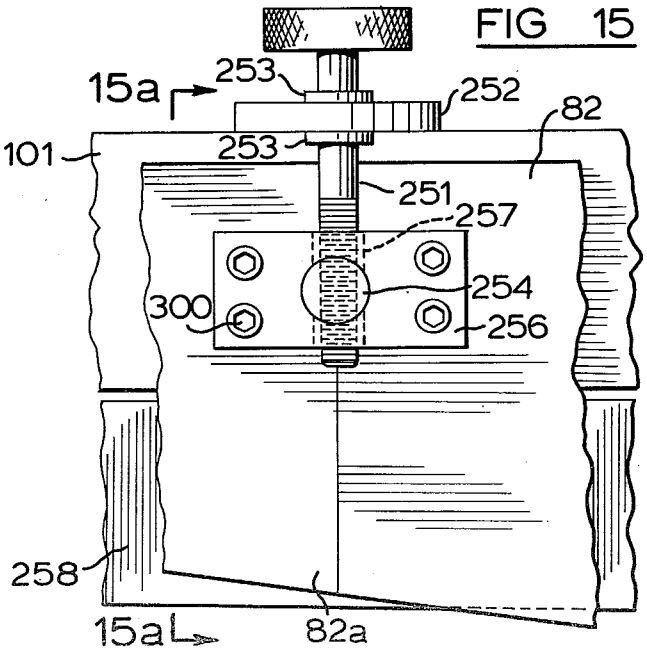
FIG. 15 shows in plan an adjustment for the expander arms.
Figure 16:
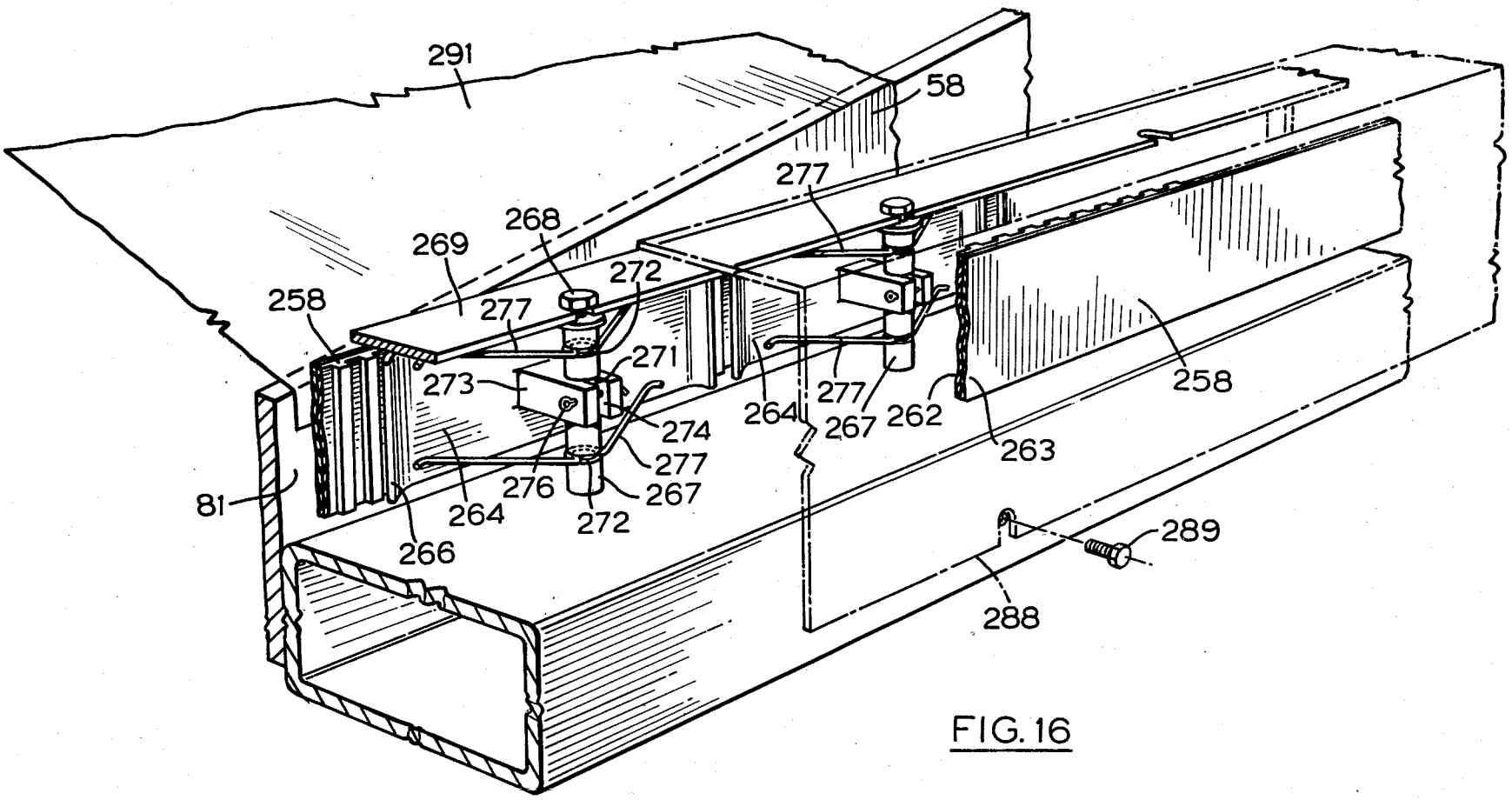
Figure 17:
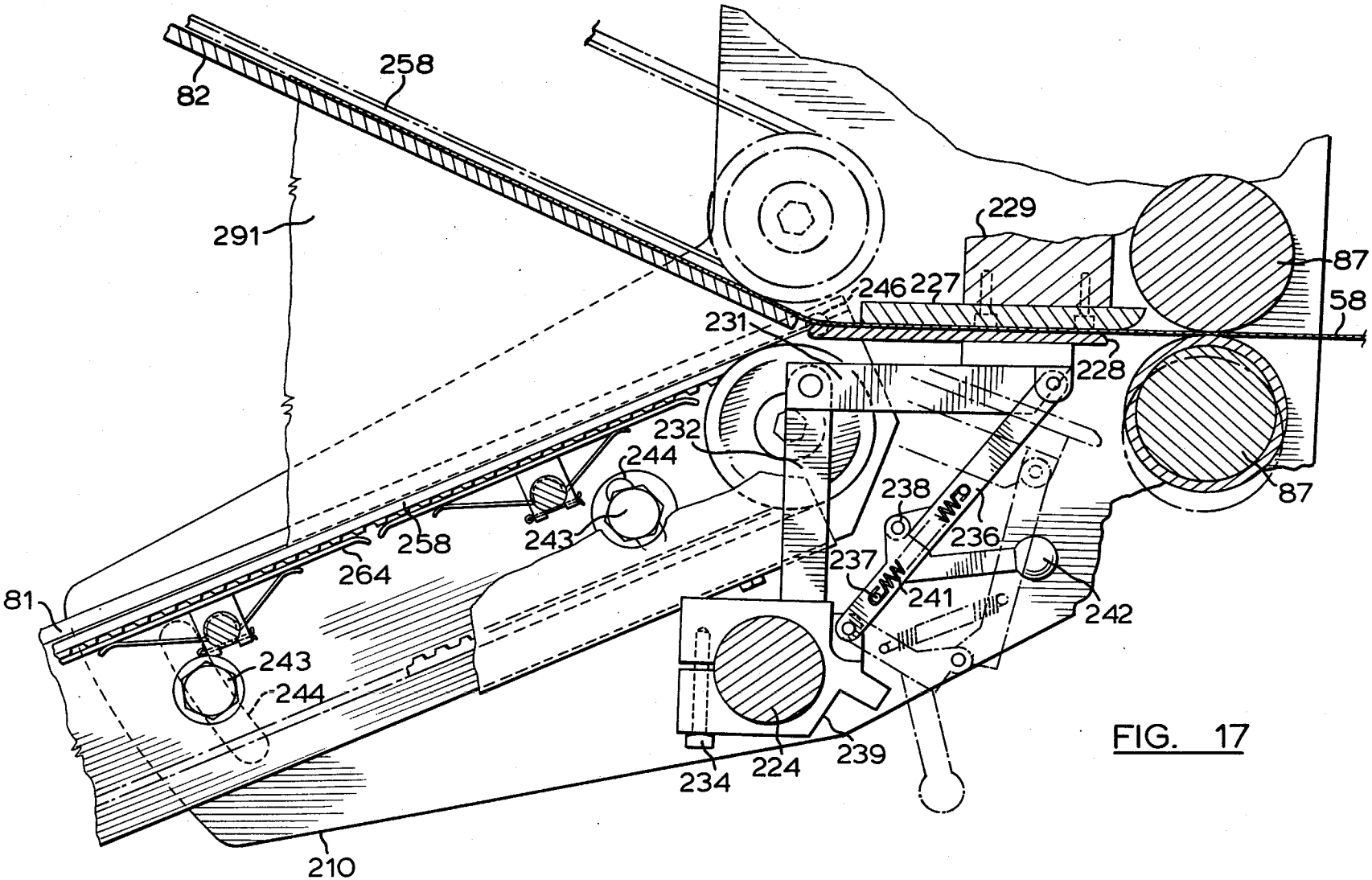
Figure 18:
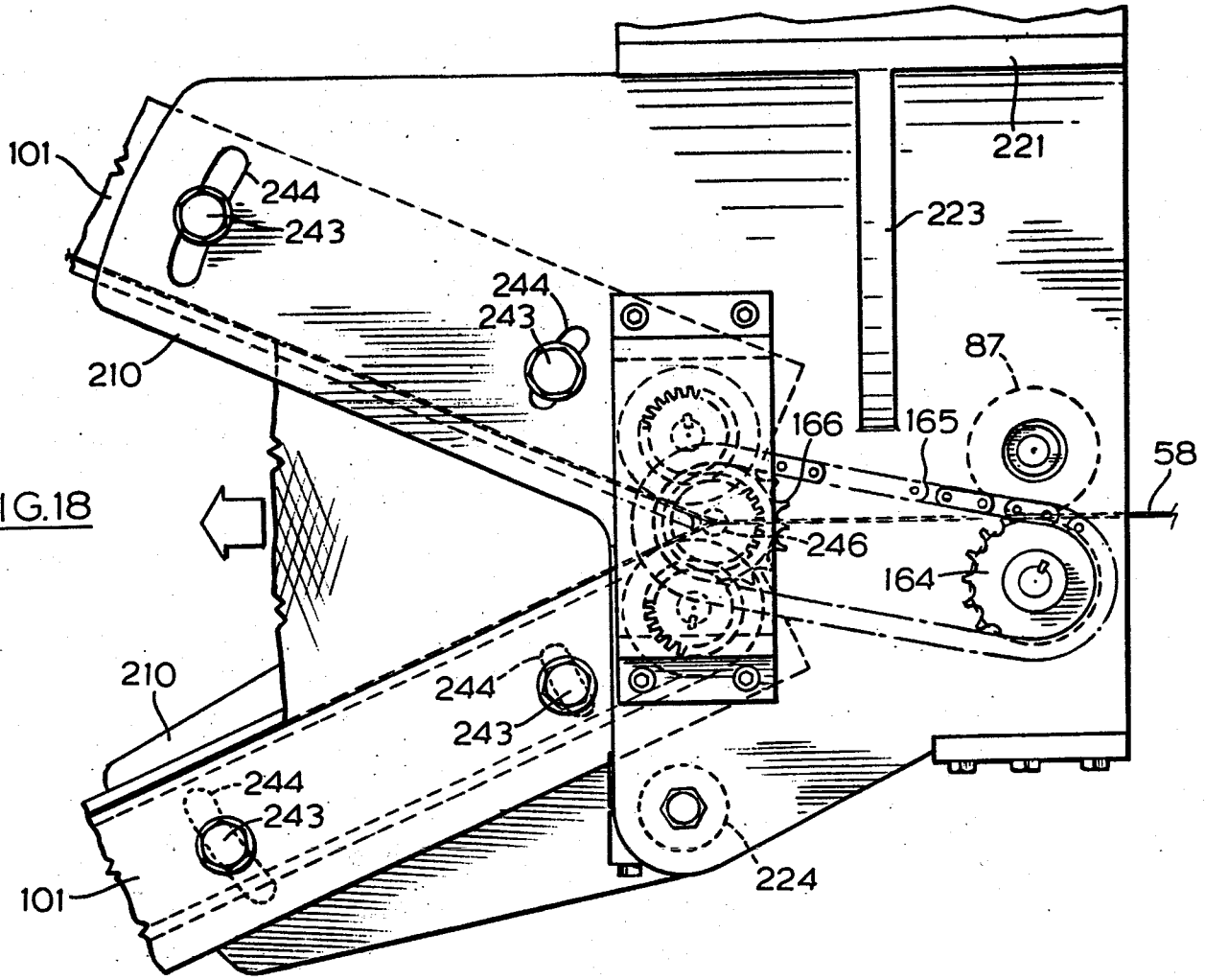
Figure 19:
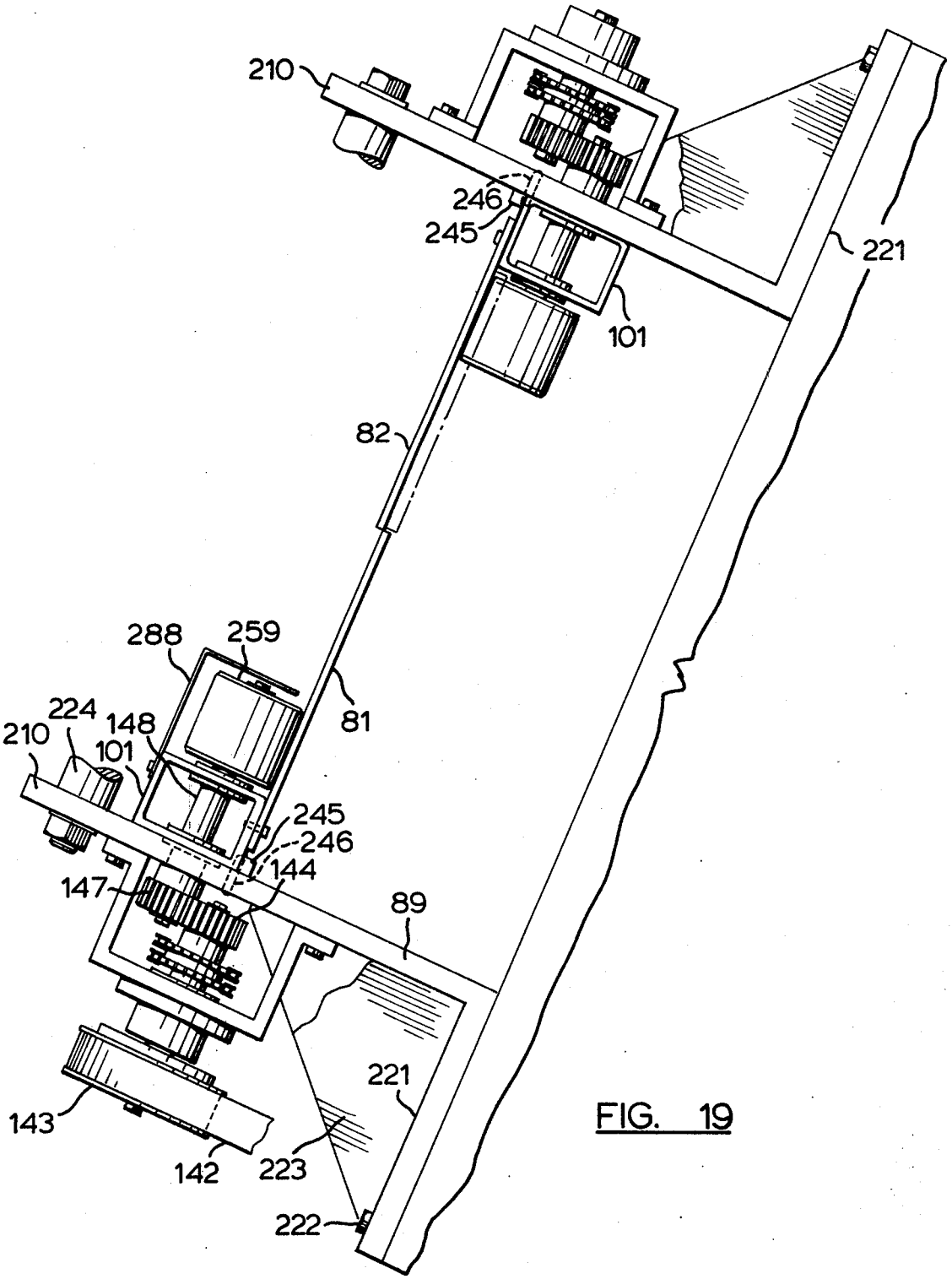

FIG. **15*a* shows a transverse section on the line 15*a*—15*a* of FIG. 15**;

FIG. 16 is a fragmentary view of the expander arm;

FIG. 17 shows the support arrangement for the endless belts and the expander arms at the input side of the machine, partly in section on the line 17—17 of FIG. 1;

FIG. 18 is a view similar to FIG. 17 showing the outer side of the upper expander arm on the line 18—18 of FIG. 1; and FIG. 19 shows a view from the rear of the expander arms along the line 19—19 of FIG. 11.

DESCRIPTION OF THE PREFERRED EMBODIMENTS

Referring to the drawings, wherein like reference numerals indicate like parts, the machines comprise a main frame 20, and a sub-frame 21 pivoting on the main frame about horizontal axis 22. At one end, the frame 20 carries an upright 23 in which horizontal shaft 24 of the sub-frame pivots freely within a bearing 26. At this end, the sub-frame 21 is defined by a plate 27 to which shaft 24 is connected.

Figure 7:
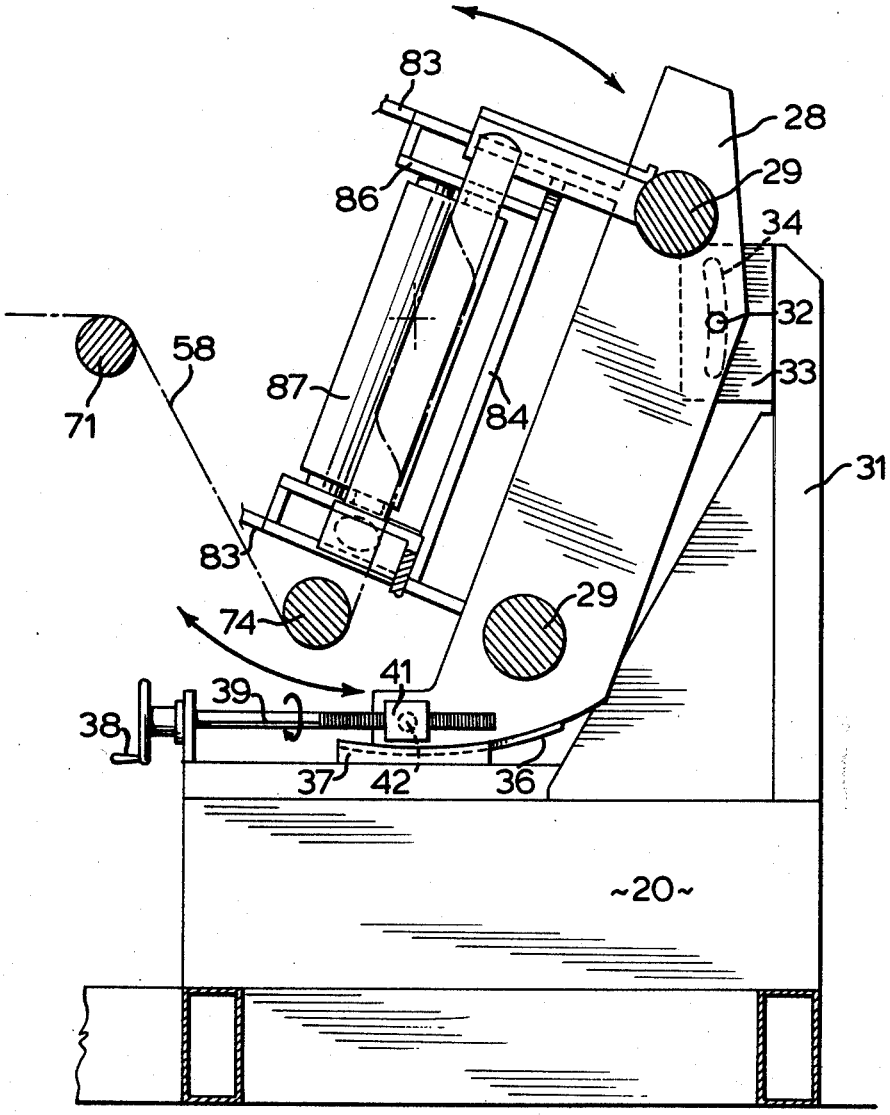
FIG. 7 is a vertical section through the main frame and sub-frame of the machine taken on the line 7—7 of FIG. 1.

The opposite end of the sub-frame is constituted by a generally D-shaped mounting portion 28 (also shown in FIG. 7) connected to the end plate 27 by a pair of vertically spaced horizontal tie rods 29.

The mounting portion 28 of the sub-frame is supported at one side on a vertical extension 31 of the main frame 20 by a locking bolt 32 for clamping the mounting portion 28 to a projection 33 of extension 31. The locking bolt 32 enters an arcuate slot 34 in the projection 33.

At its lower end, the mounting portion 28 has an arcuate raised key 36 sliding in a curved key way channel 37 secured on the main frame 20. The centre of curvature of the key way channel 37 and of the slot 34 is arranged coaxial with shaft 24, so that the whole sub-frame 21 may be rotated about this axis.

For tilting the sub-frame about this horizontal axis, a hand wheel 38 is provided on a threaded shaft 39 engaging a threaded sleeve coupled to portion 28 through a pivotal coupling 42.

A holder for a coil of slit metal stock has side plates 43, and front and rear tie bars 44 and 46 of which the front bar 44 slides at its ends in bearings 47 on the main frame 20. The rear bar 46 has a key block 48 sliding in a horizontal channel key guide way 49 connected on the frame 20, so that the whole holder may be shifted laterally. Blocks 51 are connected on the side plates 43, carrying bearings 52 through which passes a shaft 53 around which the coil stock is wound. The blocks 51 have hinged sections 54 releasably held in place by clamping screws 56 allowing the shaft 53 to be lifted from the machine when fresh coil stock is to be placed in the holder.

For keeping the feed of the slit web stock 58 in proper alignment, a pair of edge detectors 59 are mounted on frame 20 adjacent the feed of the web. These control the operation of an hydraulic cylinder 60 connected between frame 20 and one side plate 43 of the holder and shift the holder laterally in response to signals from the edge detectors 59, so that the slit metal web 58 is maintained in alignment with the horizontal axis of subframe 21.

The shaft 53 of the coil stock holder is provided with a brake to keep tension in the web and to prevent overfeeding. A brake drum 66 on one side plate 43 has a friction band 67 passing over it and is fixed at one end to the plate 43. The other end of the band 67 carries a weight 68 holding it in frictional engagement with the drum 66. The drum 66 connects to the shaft 53 through a shaft 64, a gear 63, and an upper gear 62.

The plates 43 also carry posts 69 which support a roller 71 over which the web passes towards the subframe 21.

The form of coil stock holder employed is separable as a distinct unit from the remainder of the machine. This facilitates the change-over procedure if fresh coil stock is to be substituted, and may enable the coil stock holder to be employed for reeling up slit foil supplied from a metal slitting machine. In FIG. 1, the main frame 20 is divided in two halves 20*a* and 20*b* separable along a joint 72. A latch 73 serves to retain the frame parts releasably together.

From the holder, the web 58 passes beneath a roller 74 journalled at one end in a bearing 76 on end plate 27 and at the other end is an extension of the D-shaped mounting portion 28. The web 58 then passes to a smooth circular section bar 77 non-rotatably secured to end supports 78 connected on the tie rods 29. The axis of the bar 77 is parallel to the plane of the web at a region 79 where it subsequently approaches a pair of diverging expander arms 81 and 82. The upper surface of the bar 77 is aligned with the rear end edges of the arms 81 and 82 and its axis is inclined with respect to the direction of travel of the web along the expander arms 81 and 82, so as to redirect the web from its initial direction of lateral feed from the coil stock holder, to the arms 81 and 82. In the present instance, where the coil stock holder and the expander arms 81 and 82 are arranged perpendicular to one another, the axis of the bar 77 is inclined at 45° to the final direction of travel along the arms 81 and 82.

We have found that if a roller is used instead of the non-rotatable bar 77, the web tends to creep upwardly along the roller, resulting in misaligned delivery of the web.

In the embodiment illustrated in FIGS. 1 to 10, a pair of spaced parallel outer side plates 83 connected by a cross brace 84 are fixed on mounting portion 28. On the inner sides of plates 83 are connected a pair of housings 86 supporting driven rubber-surfaced rollers 87 through the nip of which the web 58 is drawn.

Figure 4:
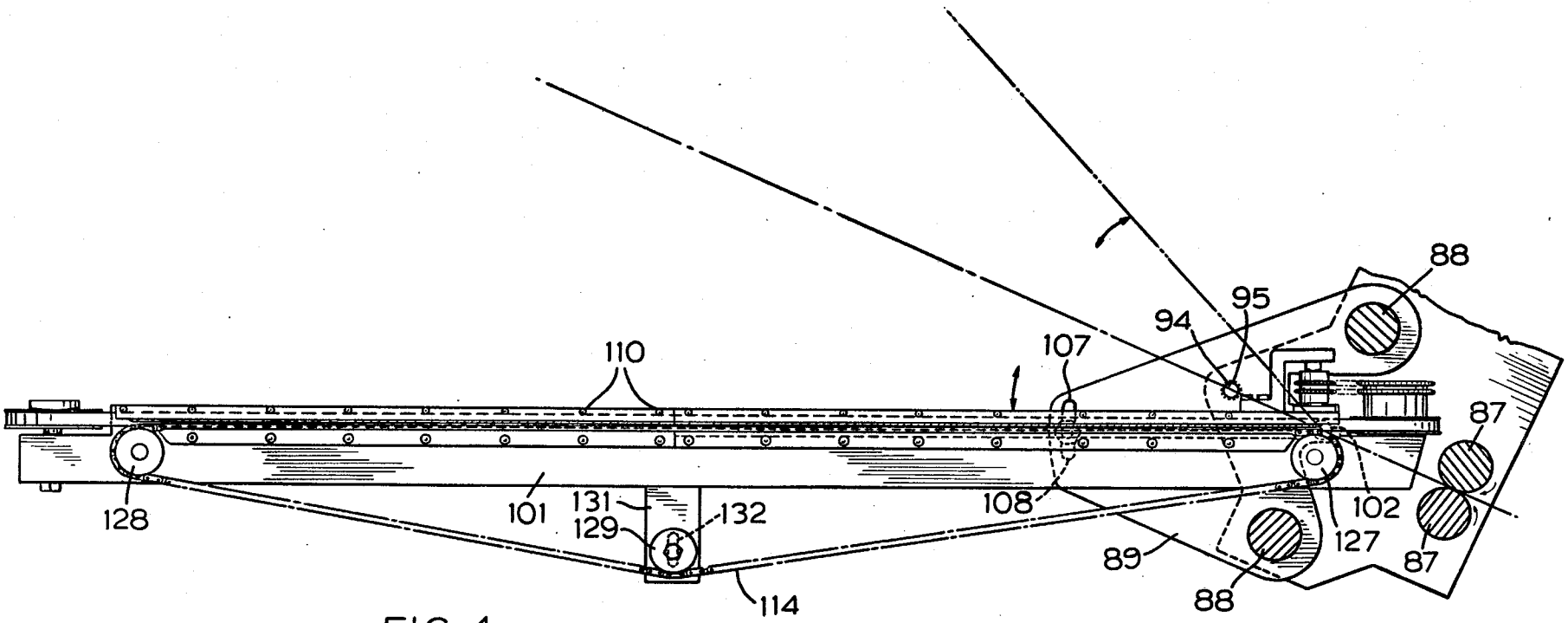
FIG. 4 shows a side view of one expander arm of the machine taken on the line 4—4 of FIG. 1.
Figure 9:
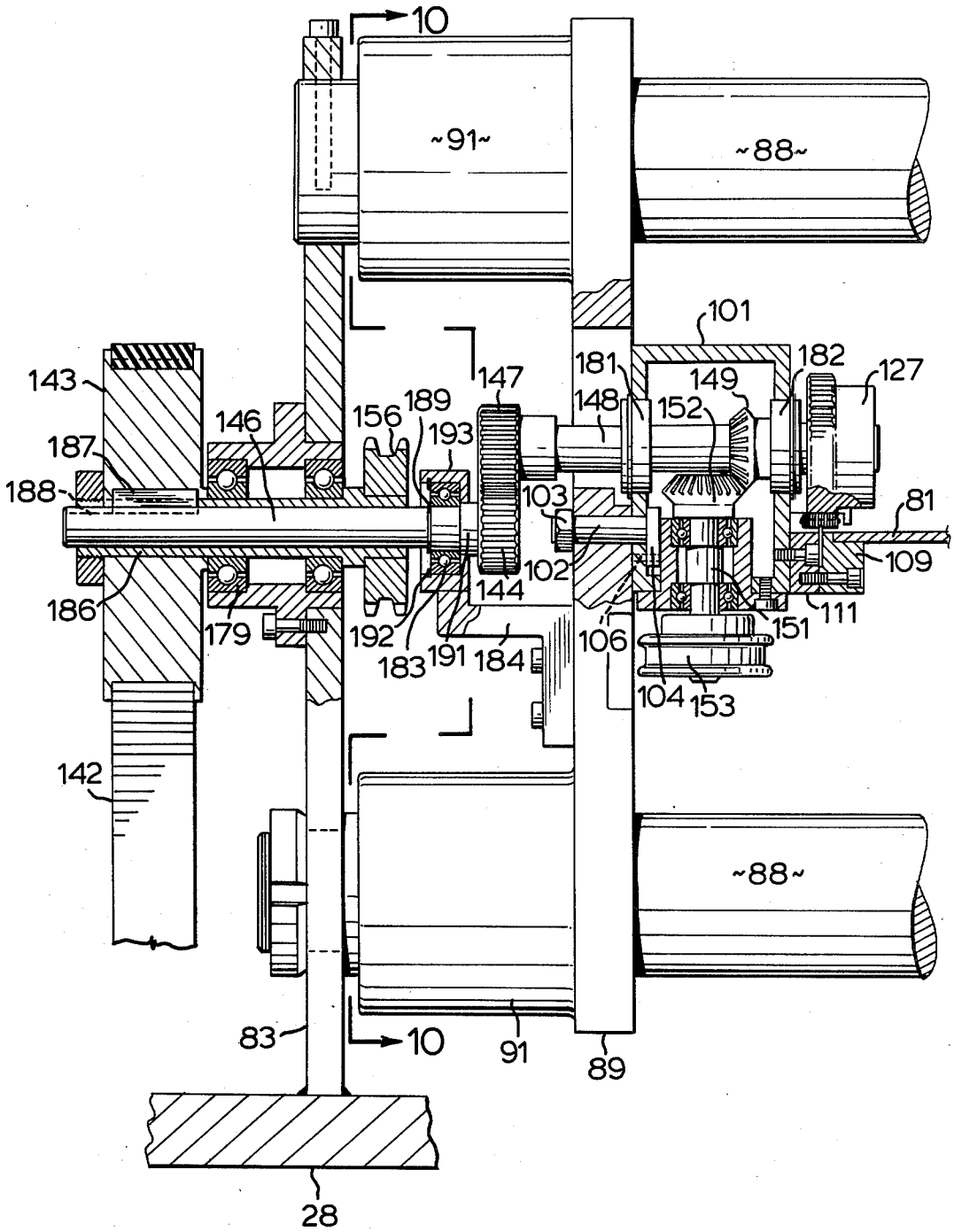
FIG. 9 shows a transverse partial section through the support structure for the expander arms on the line 9—9 of FIG. 1.
Figure 10:
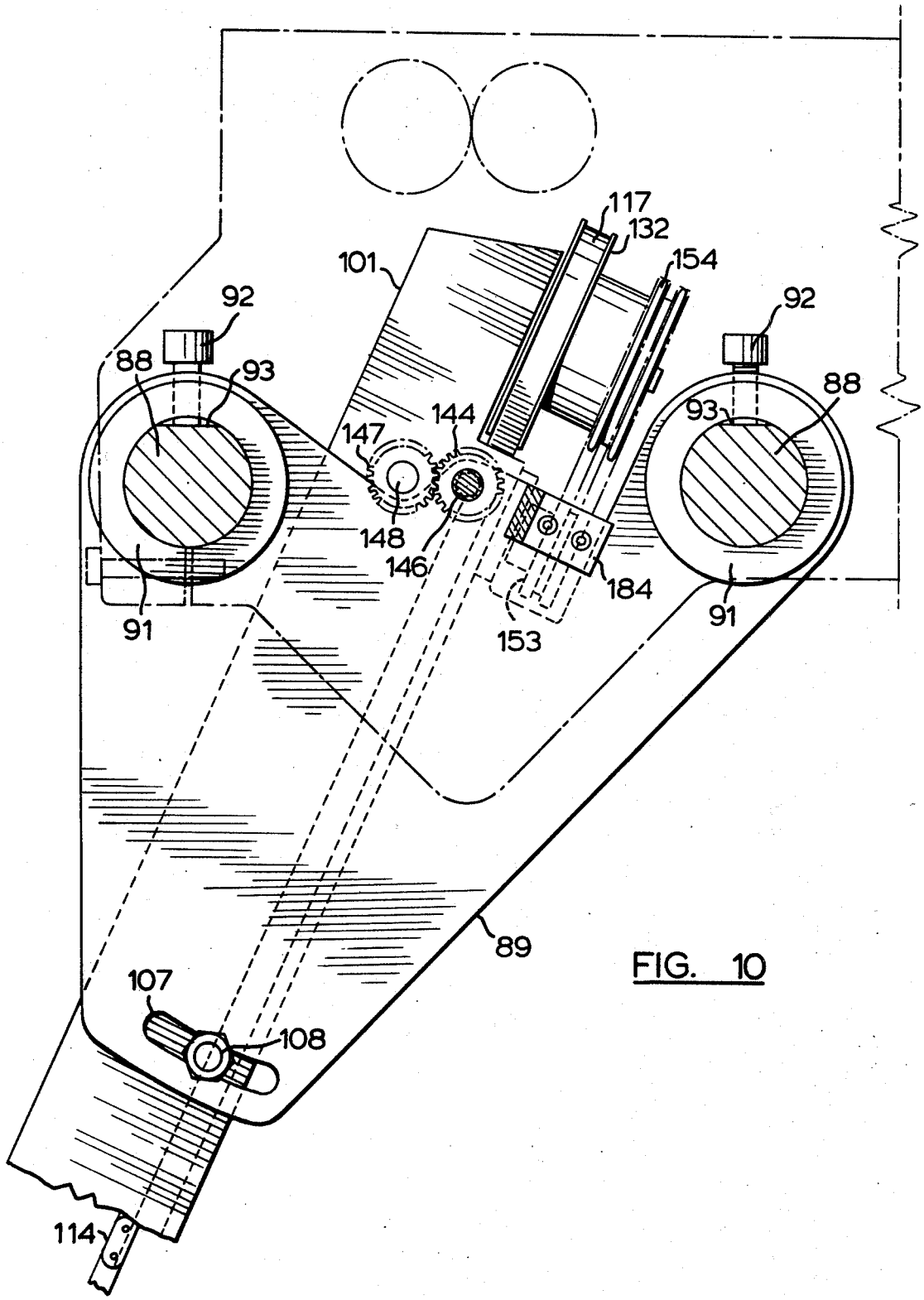
FIG. 10 shows a vertical section through the expander arm supports taken on the line 10—10 of FIG. 9.

Forwardly of the rollers 87, upper and lower transversely extending shafts 88 extend between and are connected to the plates 83. As shown in FIGS. 4, 9 and 10, these shafts 88 slidingly support a pair of inner plates 89 which have bushings 91 through which the shafts 88 pass. The plates can be fixed at any desired spacing apart by set screws 92 engaging on flats 93 on the surfaces of the shafts 88.

These slidable inner plates 89 support the expander arms 81 and 82, so that the lateral spacing of the expander arms can be adjusted. For controlling this adjustment, bolts 94 are provided which extend inwardly from the outer plates 83 and are threaded at their ends 95 in holes in the inner plates 89. The outer ends of the bolts 94 are retained against axial movement in the outer plates 83 by collars 96 fixed on the bolts 94 and engaging on the plates 83.

Support arms 101, which carry the expander arms 81 and 82, are connected pivotally on the inner sides of the plates 89. As shown in FIGS. 4 and 9, a bolt 102 passes through each of the side plates 89 and through the outer wall of the support arm 101. The outer end of the bolt 102 carries a nut 103, and the inner end of each bolt 102 carries a disc 104 which is fixed to the outer wall of the support arm 101 through a pin 106 passing through the outer wall of the arm 101. When the nut 103 is loosened, the support arms 101 together with the expander arms 81 and 82 can be tilted upwardly and downwardly about the axes of the bolts 102.

Forwardly of the bolt 102, each inner plate 89 has an arcuate slot 107 through which the support arm is further connected to the plate 89 by a clamping bolt 108 which has to be loosened before making pivotal adjustment of the support arms 101 and the expander arms 81 and 82. A calibrated scale may be provided along the slot 107 to indicate the angle of the arm 81 or 82.

Figures 5, 6:
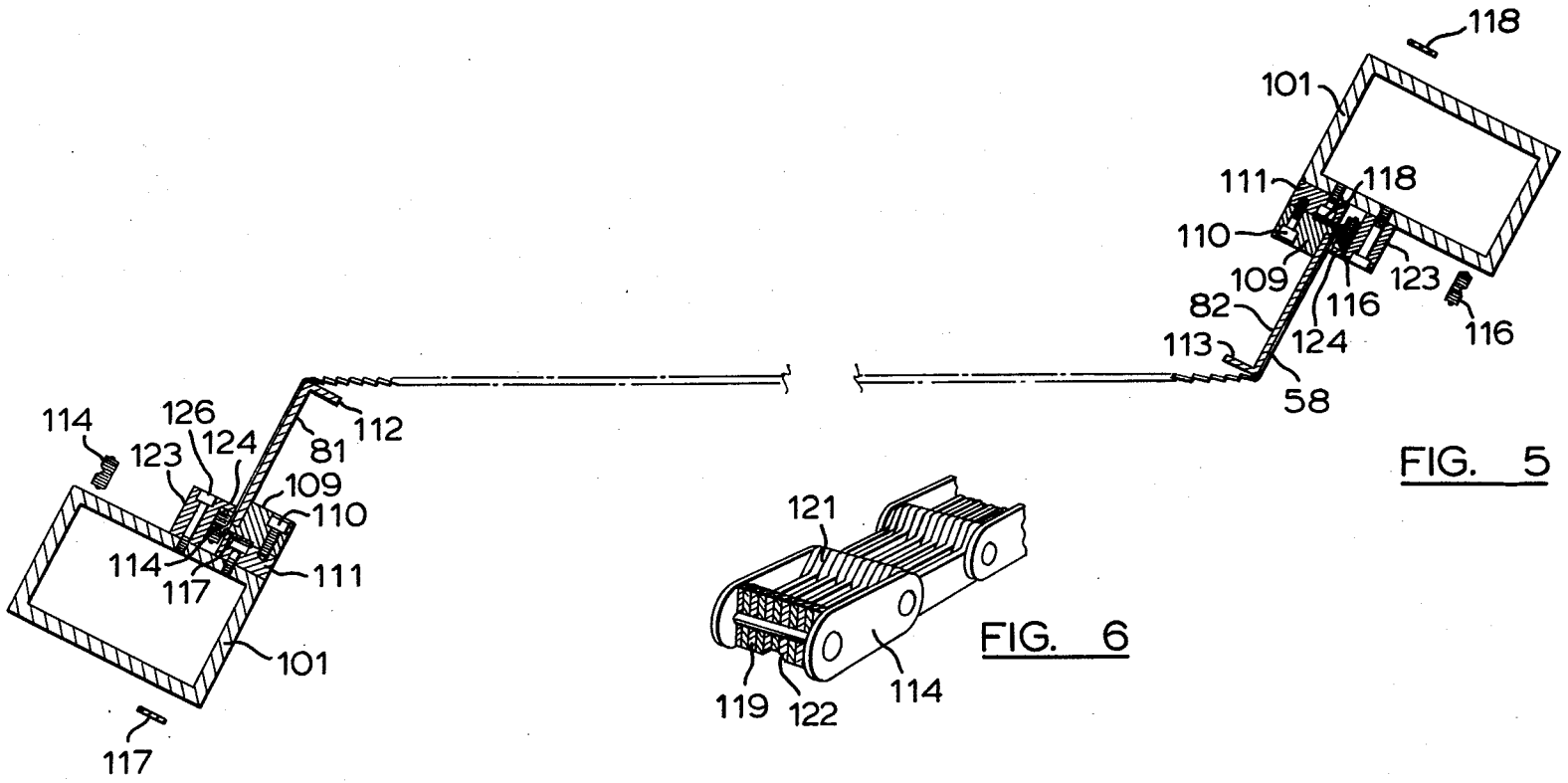
FIG. 5 shows a cross-section through the expander arms taken on the line 5—5 of FIG. 1.
FIG. 6 shows a detail of a belt of the web-conveying arrangement.

As shown in FIGS. 5 and 9, the expander arms 81 and 82 are secured along their outer edges, for example by welding, to supporting strips 109 connected by bolts 110 to strips 111 bolted to the outer sides of the support arms 101.

The expander arms 82 are in the form of generally triangular flat plates and have mutually oppositely directed lip flanges 112 and 113, respectively, along their diverging inner edges. The rear edges of the expander arms 81 and 82 are parallel and slightly offset, one above the other. Relative to the plane of the web 58 and the region 79 where it approaches the expander arms 81 and 82, the left hand arm 81 is inclined upwardly in the longitudinal direction of travel of the web, while the right hand arm 82 is inclined downwardly. The expander arms 81 and 82 are also inclined to the horizontal in the transverse direction.

The flat plates which constitute the expander arms 81 and 82 lie perpendicularly to the planes through which their respective support arms 101 pivot about the pivotal support bolts 102. Thus, with the expander arms 81 and 82 inclined upwardly and downwardly with respect to the initial plane of the input web at the point where it enters the expander arms, the inner edges of the expander arms 81 and 82 diverge, from a point where the inner edges co-incide one above the other, in both the transverse and longitudinal directions in the direction from the entrance ends of the expander arms to their exit ends.

Each of the expander arms 81 and 82 is provided with gripper devices for retaining and conveying the edges of the web in its travel along the expander arms. In the embodiment of FIGS. 1 to 10, the gripper device comprises grooved endless belts 114 and 116, and ribbon form blade-like endless belts 117 and 118 which cooperate with the grooved belts.

As shown in FIG. 6, the belt 114 comprises an assembly of plate-like metal links 119 e.g. of steel, having toothed projections 121 which engage with the drive sprockets for the belt. Standard Morse silent chains may be employed as the belts 114 and 116. A groove 122 is machined on the outer side of each belt.

As best shown in FIG. 5, the grooved belts 114 and 116 run adjacent the outer edges of the expander arms 81 and 82 and are located and guided by guide bars 123 having retaining lip portions 124. The guide bars 123 are secured on the support arms wire 1 by bolts 126.

Figure 3:
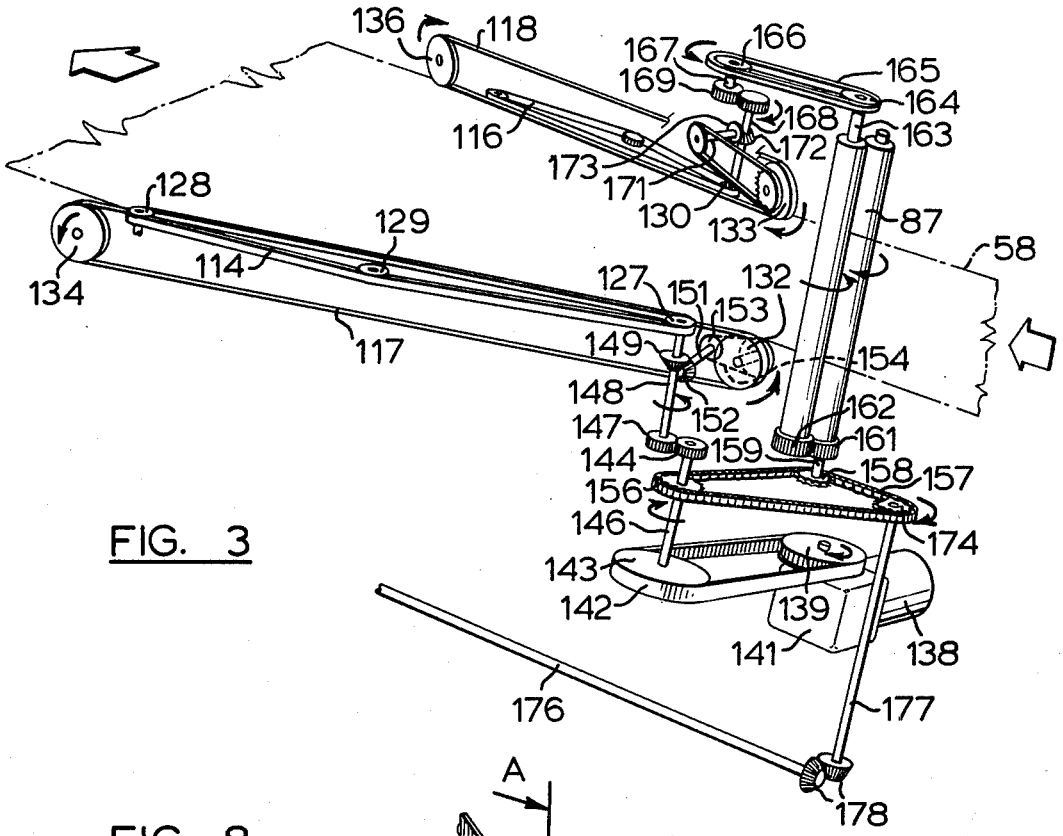
FIG. 3 shows the mechanical drive mechanism of the machine.

As shown in FIG. 3 and 4, the grooved belts 114 and 116 extend around sprockets 127 and 130 at the rear end of the support arms 101, pass around an idler pulley 128 mounted at the forward end of the support arms 101, and over a tensioning idler pulley 129 supported on a bracket 131 midway along the support arm 101. The tensioning pulley 129 is movably supported in a slot 132 in the bracket plate 131, so that the tension in the grooved belts can be adjusted. The support arms 101 may be provided with a plurality of sockets spaced longitudinally for supporting the idler pulley 128 at various positions along the arm 101. This allows the effective length of the gripping run of the belts 114 and 116 to be adjusted, so that the point at which the web loses gripping contact with the belts 114 and 116 can be adjusted, to allow webs of different widths to be expanded on the machine. In the preferred form, the bracket 131 supporting the tensioning pulley 129 is detachably mounted on the arm 101, so that a bracket of different arm length may be substituted allowing the length of the effective gripping run of the belts 114 and 116 to be changed considerably without needing to substitute fresh belts of different lengths for the belts 114 and 116.

The endless blade-like belts 117 and 118 which cooperate with the grooved belts 114 and 116 extend around drive pulleys 132 and 133 connected on the rear ends of the support arms 101, and pass around respective tensioning pulleys 134 and 136 adjustably mounted in slots 137 at the forward end of the support arms 101.

As can be seen in FIGS. 1, 3, 4 and 5, the axes of the pulleys 127, 128, and 129 supporting the grooved belt 114 on one side of the machine are at right angles to the axes of the pulleys 132 and 134 for the adjacent blade-like belt 117, and similarly on the opposite side of the machine, so that the grooved belts 114 and 116 run perpendicularly to the blade-like belts 117 and 118. In operation, the web is fed forwardly from the rollers 87 and its edges become gripped at the point where the sprockets 127 and 130 press the grooved belts 114 and 116 into contact with the blade-like belts 117 and 118. Adjacent the outer edges of the plates 81 and 82, the blade-like belts 117 and 118 run in a groove formed between the supporting strips 109 and the spacer strips 11.

Referring now to FIG. 3, the drive mechanism for the belts 114, 116, 117 and 118 is shown. A motor 138 drives a pulley 139 through a gear box 141. A belt 142 transmits the drive to a main drive pulley 143 which turns a spur gear 144 carried on a shaft 146 extending transversely of the adjacent support arm 101 carrying the expander arm 81. The gear 144 meshes with a spur gear 147 driving a parallel shaft 148 which turns the sprocket 127, driving the grooved belt 114 through engagement with the teeth 121 on the inner side of the grooved belt 114. A bevel gear 149 on the shaft 148 drives a perpendicular shaft 151 through a bevel gear 152, and the shaft 151 turns a pulley 153 connected through a belt 154 to the pulley 132 which drives the blade-like belt 117.

The main drive pulley 143 connects co-axially with a sprocket wheel 156 driving a chain 157 which turns a sprocket wheel 158 connected through a shaft 159 to one of the rubber covered rollers 87 which feed the web 58 towards the expander arms 81 and 82. The rollers 87 are coupled together through interengaging gears 161 and 162 at one end. A shaft 163 extending from one of the rollers 87 at the other end drives a sprocket 164. This is coupled through a chain 165, to a sprocket wheel 166 connected on a shaft 167. The shaft 167 drives the grooved belt 116 and the blade-like belt 118 through a mechanism generally similar to that already described in connection with the belts 114 and 117, including a transverse shaft 168 driven through spur gears 169 and 171, and a perpendicular shaft 171 driven through bevel gears 172 and 173.

It should be noted that the chain 157 which drives the rubber covered feed rollers 87 additionally drives a sprocket wheel 174 coupled to a power take-off shaft 176 through a shaft 177 and a pair of bevel gears 178. The power take-off shaft 176 may be used to drive apparatus which composes the output web of expanded metal from the expander machine into a multiple layer mass, or may serve to synchronize the operation of such apparatus with the operation of the expander machine. FIGS. 9 and 10 show in greater detail the arrangement of the drive mechanism for the grooved belt 114 and the blade-like belt 117 on the side of the expander machine carrying the expander arm 81. It will be seen that the main drive pulley 183 together with the transverse drive shaft 146 is supported on bearings 179 connected on the outer side plate 83. The drive shaft 148 is supported on bearings 181 and 182 secured to the support arm 101 which is connected to the inner side plate 89.

In order to permit lateral adjustment of the position of the side plate 89, provision has to be made for adjustment of the drive shaft 148 relative to the main drive pulley 143. This is achieved by supporting the shaft 146 at one end in a bearing 183 connected through a bracket 184 to the inner side plate 89, and having the shaft 146 slidingly adjustable within a cylindrical sleeve 186 which is keyed to both the main drive pulley 183 and the shaft 146 by a key member 187 secured internally to the main drive pulley 143, passing through an axially-extending slot in the sleeve 186, and engaging in an axial groove 188 in the shaft 146. The shaft 146 is lightly retained by the bracket 184 by a C clip 189 holding the shaft 146 against the inner race of the bearing 183, the other side of the inner race engaging with an enlarged diameter end portion 191 on the shaft 146. The outer race of the bearing 183 is lightly pressed by a C clip 192 into a cup 193 connected to the bracket 184.

As the shaft 146 slides relatively freely in the sleeve 186, it traverses laterally together with the bracket 184, the side plate 89, and the shaft 148 when the position of the inner side plate 89 is adjusted.

On the opposite side of the machine, similar allowance has to be made for lateral adjustment of the spur gear 169 relative to the sprocket wheel 166, and this is achieved by supporting the shaft 167 in a bearing on the inner side plate 89 which is lightly resistant to axial movement of the shaft relative to the plate 89, and having the shaft 167 keyed to the sprocket wheel 166 through an arrangement allowing free relative axial movement.

In operation, the pre-slit web 58 from the coil stock 57 is fed forwardly, through the nip of the driven feed rollers 87 to the entrance zone between the upper expander arm 82 and the lower expander arm 81, where its edges are gripped by the two sets of blade-like belts 117 and 118 and grooved belts 114 and 116, which draw the web forwardly along the expander arms 81 and 82. The edge gripping action, wherein the metal web 58 is pressed into the groove 122 of the belts 114 and 116 by the blade belts 117 and 118, and is deformed, is shown in FIG. 5. The web is carried longitudinally over the upper surface of the left-hand expander arm 81 and over the lower surface of the right-hand expander arm 82. With the left-hand expander arm 81 inclined upwardly with respect to the initial plane of the web 58, and the right-hand expander arm 82 inclined downwardly, the inner edges of the expander arms 81 and 82 diverge both in the lateral direction and in the direction normal to the initial plane of the web. As the web moves progressively forwardly, it slips laterally over the inner edges of the expander arms.

Figure 8:
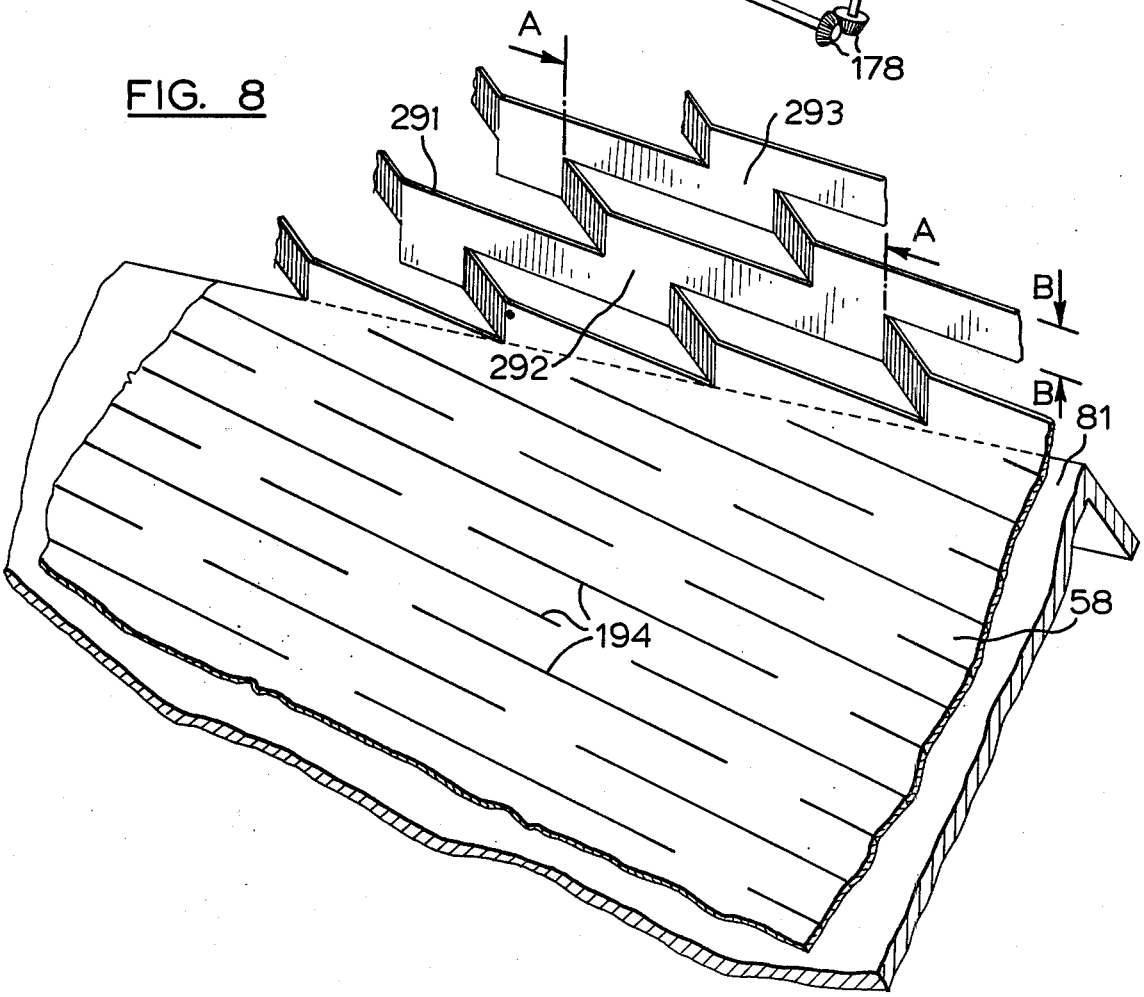
FIG. 8, which appears on the same sheet as FIG. 3, shows in detail the slippage of slit foil over the inclined edge of the expander arms in the region encircled at 8 in FIG. 1.

FIG. 8 shows the expansion of slit metal foil 58, which has an array of parallel longitudinal slits 194 of uniform length arranged in regularly spaced parallel longitudinal rows, with the slits in adjacent rows being longitudinally staggered with respect to one another. As a result of the divergence of the expander arms 81 and 82, a lateral force of tension is developed in the web 58 causing the slits 194 to open out into diamond shaped meshes along the zones where the web 58 passes over the edges of the expander arms. In the regions of the web 58 remaining in contact with the flat surfaces of the expander arms 81 and 82, the web 58 is supported against deformation, and the slits 194 thus remain unopened until the web 58 slips over the edge of the expander arm.

In order to obtain uniformly sized and orientated diamond shaped meshes, it is desirable to arrange the expander arms 81 and 82 so that their inner edges are inclined with respect to the slits 194 in the web so as to be parallel to the angle at which laterally adjacent slits 194 are off-set. This orientation is shown in FIG. 8.

The degree of lateral expansion of the web, i.e. the increase in the width of the expanded web as compared with the original web can be varied by swinging the expander arms 81 and 82 towards or away from one another about the axes of the bolts 102.

When adjustments are made in the angles of inclination of the arms 81 and 82, by tilting the support arms 101 about the axes of the bolts 102, the forward ends of the expander arms 81 and 82, where the output expanded web is released from gripping engagement between the two sets of belts 114, 117 and 116, 118, will swing about a tilted axis, so that one arm becomes raised while the other lowers as the adjustment is made. Once the adjustment is made, the sub-frame 21 of the machine can be tilted about the axis 22 by turning the handwheel 38, thus restoring the plane of the output expanded web to the horizontal.

The machine can be adjusted to accommodate webs of differing widths by adjusting the positions of the inner side plates 89, employing the adjustment bolts 94 to move the plates 89 together with the support arms 101 and the two sets of gripping belts 114, 117 and 116, 118, towards or away from one another. To avoid overlap of the rear edges of the expander arms 81 and 82, which would cause undue strain in the web, or to avoid a gap occurring between the expander arms at the entrance end which would leave the web unsupported and result in the unsupported portion of the web opening out into randomly orientated meshes, a fresh set of expander arms may need to be substituted for the expander arms 81 and 82 when the lateral adjustment is made.

As explained above, it is desirable to maintain a predetermined orientation between the slit lines in the web and the inner edges of the expander arms. Thus, where a web of different width but with the same size and configuration of slit lines is to be expanded, the expander arms which will be substituted in the machine will be geometrically similar to the original expander arms.

As will be noted from the preceding description, a fresh set of expander arms can be relatively easily substituted in the machine by unscrewing the bolts 110, removing the existing expander arms 81 and 82, and inserting a fresh set of expander arms equipped with their own supporting strips 109 which have sets of holes for receiving the bolts 110.

When a fresh set of expander arms is fitted to the machine, the length of the effective gripping run of the belts 114, 117 and 116, 118 needs to be altered so that the web is released from gripping engagement at the point where it leaves the forward end of the expander arms. This adjustment is carried out by moving the position of the forward idler pulleys 128 which carry the grooved belts 116, the pulleys 128 being moved to another of the sockets provided for this purpose in the support arms 101. The positions of the tensioning pulleys 129 are also adjusted, to ensure that tension is maintained in the belts 114 and 116, and if necessary the supporting brackets 131 for the pulleys 129 are replaced with brackets of different lengths.

Referring now to the embodiment illustrated in FIGS. 11 to 19, in this embodiment the edges of the web, instead of being gripped along a narrow deformation line (the line of the groove 122), are gripped at each edge between a smooth surface and a wide belt. As the wide belt can accommodate some variation in the width of the web, it is not required that the lateral spacing of the expander arms should be adjustable. Thus in this embodiment, the mounting portion 28 of the sub-frame 21 has a pair of supporting side plates 210 that are attached directly to the mounting portion 28.

Each plate 210 has a right-angled lower rear extension 221, through which the plates 210 are bolted on the mounting portion 28 with bolts 222. The plates 210 are braced on the outer sides by triangular fillets 223. The upper parts of the plates 210 are connected by a cylindrical cross brace 224, and the lower parts by a rectangular channel section cross brace 226.

The upper of the two rubber-covered rollers 87 is vertically slidably mounted on the plates 210, and a control bar 225 extending between the plates 210 serves to control upward and downward shifting of the upper roller. The bar 225 is rotatably mounted in each plate 210 and at each end carries an eccentric pin connected to the mounting of the upper roller, whereby when the bar 225 is rotated, the upper roller 87 can be shifted upwardly so as to be separated from the lower roller to facilitate threading the web 58 into the machine and can thereafter be closed up again to grip the web firmly. An operating handle **225*a* is connected on the bar 225 for rotating the bar 225**.

Forwardly of the rollers 87, the web 58 is supported between and guided by a pair of guide plates 227 and 228, best seen in FIG. 17, which are aligned with the nip of the rollers 87. For the sake of clarity of the drawing, the arrangement for supporting the plates 227 and 228 is not shown in FIG. 1. The plate 227 is carried on a pair of spaced arms 229 connected to the channel-section cross-brace 226. The plate 228 is carried on a pair of transversely spaced arms 231 which are pivotally connected to arms 232, allowing the plate 228 to be swung towards and away from the plate 227. Each arm 232 is connected through a rotatably adjustable mounting on the cylindrical cross brace 224. The plate 228 is movable by hand towards and away from the plate 227 through operation of a spring-loaded toggle linkage, comprising a bar 236 pivotally connected to the middle portion of the plate 228, and a bar 237 pivotally connected to the bar 236 at a knee 238 and itself pivotally mounted on a split clamp 239 secured with a clamping screw 234 on the cylindrical cross brace 224 between the clamps 233. The two parts of the toggle linkage 236 and 237 are biased together by a tension spring 241, and are shiftable by a hand lever 242 from the closed position shown in solid lines to the open position shown in broken lines in which the plate 228 is swung open to allow the leading edge of the web 58 to be fed into the machine.

As shown in FIG. 17, the leading and trailing edges of the guide plates 227 and 228 are rounded to avoid tearing of the thin foils with which the machine is intended to be used.

On loosening the clamp 239, the position of the guide plate 228 can be adjusted to align it parallel with the plate 227.

A pair of hollow rectangular section support arms 101, which carry the expander arms 81 and 82, are supported on the inner sides of the side plates 210 forwardly of the guide plates 227 and 228. As shown in FIGS. 17 and 18, each arm 101 is supported on its plate 210 through two bolts 243 passing through arcuate slots 244 in the outer wall of each support arm 101.

Each support arm 101 is pivotally connected to its adjacent side plate 210 through a dowel pin 246, the position of which is shown in FIGS. 17, 18 and 19, located in a bore passing perpendicularly through the side plate 89 and in a bore passing partly through the wall of the arm 101 and partly through a small block 245 welded on the support arm 101. The arcuate slots 244 in the support arms 101 are concentric with the dowel pins 246, so that when the bolts 243 are loosened the angle between the support arms 101 can be adjusted by swinging them about the pivotal axis provided by the dowel pins. The two dowel pins 246 are coaxial, so that the support arms 101 together with the expander arms 81 and 82 pivot about a common axis.

As shown in FIG. 11, each of the expander arms 81 and 82 is secured to the support arms 101 by a bolt 247 fitting in a circular hole at the rear or entrance end of the expander arm, and acting as a pivot point about which the expander arm can be swung in its own plane, and a series of bolts 248 passing through short arcuate slots 249 concentric with the bolt 247, to allow limited swinging adjustment of the expander arms 81 and 82 relative to their respective support arms 101 about the bolt 247. A fine adjustment member is provided on each arm for controlling this adjustment. The adjustment member, as shown in FIGS. 1 and 6, consists of a screw 251 passing through a bracket 252 connected on the arm 101. The screw 251 is retained against axial movement by bosses 253 connected on the screw 251 and abutting on opposite sides of the bracket 252. The screw 251 threads into a dowel 254 freely turning in a block 256 fixed on the expander arm 82. Within the block 256 is a bore 257 which accommodates the screw 251 with sufficient clearance to allow for the limited swinging of the block 256 relative to the screw 251. A knurled knob 255 is provided for turning the screw 251, so as to shift the arm 81 transversely relative to the support arm 101.

The gripper device for retaining the edge of the web 58 and conveying it along the expander arm, comprises an endless resilient belt 258 which runs along the expander arm adjacent the outer margin thereof in contact with the surface of the arm 81 or 82 over which the web 58 travels.

Each belt 258 is supported at opposite ends of the expander arm on pulleys 259 and 261 which are mounted on the inner sides of the support arms 101. The pulley 259 at the rear end of the expander arm is driven while the pulley 261 at the front end is an idler pulley. The pulleys 259 and 261 and the inner surface of the belts 258 have cooperating ribbing to give a positive engagement and positive drive to the belts. As shown in FIG. 16, the belts 258 may be of composite construction, consisting of an inner ribbed wear resistant layer 262 and a thin outer facing layer 263 of a softer resilient material adhered thereto, e.g. of neoprene rubber, which can better engage with the webs to be expanded.

The run of the belts 258 which lies adjacent the respective expander arms 81 or 82 is pressed towards the expander arm for increased frictional engagement with the web 58 by a series of pressure shoes 264. The shoes 264 are arranged along the entire length of the belt with only small spacing between the individual shoes, and each shoe consists of a flat metal plate with gently upwardly curved ends 266 to avoid the edges of the ribbing on the belt 258 catching on the end edges of the shoes.

Each shoe 264 is retained loosely on a central post 267 lying parallel with the general plane of the shoe and secured at its outer end by connection to the inner side of the support arm 101. At its inner end each post 267 receives a bolt 268 which retains a guide strip 269 extending along the inner edges of the shoes 266 and partly overlapping and engaging against the side edge of the belt 258 so as to guide the belt 28 and retain it against transverse movement.

The post 267 has a narrow central portion 271, and a pair of circumferential grooves 272 spaced on either side of the portion 271. Each shoe has a guide block 273 secured centrally thereto which is formed at its free end with a central slot 274 receiving the necked portion 271 in loosely rubbing engagement. The sides of the guide block 273 are in rubbing engagement with the end shoulders of the necked portion 271. A split pin 276 may be passed through the free end of the guide block 273, so that the guide block 273 together with the shoe 266 is loosely retained on the post 267.

Each groove 272 in the post 267 receives a bight portion of a stiff wire spring 277, the ends of which press the shoe 266 towards the expander arm 81 so as to exert spring pressure on the belt 258 to grip and retain the edge of the web 58 against the expander arm 81.

Figure 14:
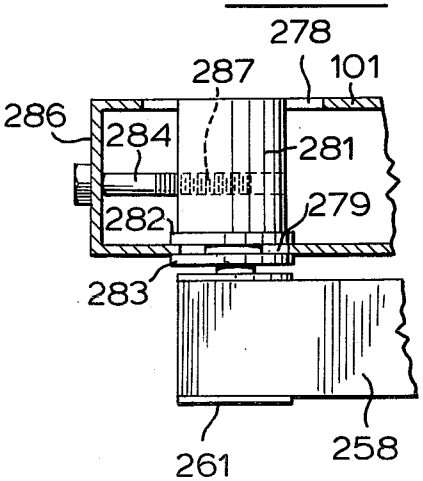
FIG. 14 shows a support for the endless belt at the output end of the expander arm, partly in section on the line 14—14 of FIG. 11.

In order to maintain a pre-determined tension in the belts 258 and to provide a tensioning adjustment for the belts 258, each idler pulley 261 has a longitudinally adjustable support, shown in FIG. 14. The support arm 101 is formed with slots 278 and 279 in its inner and outer sides which accommodate a cylindrical mounting member 281 receiving the axle of the pulley 261. At the inner side the mounting member 281 has spaced shoulder plates 282 and 283 which bear slidingly on the edges of the slot 278 in the support arm 101. Longitudinal adjustment of the position of the mounting member 281 together with the pulley 261 is effected by an adjusting bolt 284 whose head engages on the end wall 286 of the support arm 101 and whose threaded shank engages in a threaded bore 287 in the mounting member 281.

An angled-section cover 288 or guard is provided over the belt 258 and pressure shoe arrangement and is screwed to the support arm 101 with screws 289.

Figure 15A:
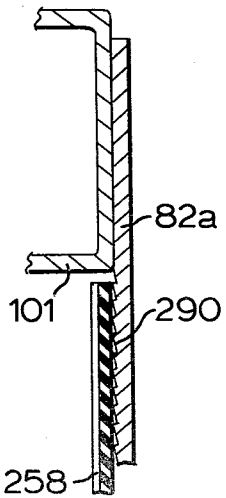

The surfaces of the arms 81 and 82 over which the web 58 travels i.e. the upper surface of the left-hand arm 81 and the lower surface of the arm 82, are made smooth surfaced at least along a major part of their length extending forwardly from the rear or entrance ends of the arms. These surfaces may be polished and may have a polished chromium-plated surface. Alternatively, the surfaces may have a low-friction coating e.g. a low-friction plastics coating such as a TEFLON coating, so that the web to be expanded will glide smoothly over the arms 81 and 82. It has been found that with this arrangement tearing, deformation or wear of thin foils to be expanded is reduced, while satisfactory grip on and retention of the edges of the web can be obtained, at least where the full width of the belts 258 is applied on the expander arm surface. However, as can best be seen from FIG. 11, at the forward end of the expander arms 81 and 82 the belts 258 extend beyond the inclining inner edges of the arms 81 and 82, and at this region the width of foil 58 gripped between the belt 258 and the arm 81 or 82 is somewhat smaller. To avoid premature release of the edges of the foil, the expander arms 81 and 82 may be grooved at the forward end on the surface adjacent the belt 258 so as to increase the frictional grip. For convenience of machining, and also to allow substitution of a smooth-surfaced end portion where it is found that the grooves are unnecessary for a satisfactory grip or that they unduly tear, deform or wear a particular foil, the expander arms have separable end pieces 81*a* and 82*a* on which the grooves 290 are formed, as shown in FIGS. 15 and 15*a*. The grooves 290 extend parallel to the support arm 101 and are of saw tooth profile with their inclining faces sloping away from the inner edges of the pieces 81*a* and 82*a* so as to give a configuration tending to resist transverse withdrawal of the foil. The end pieces 81*a* and 82*a* are retained in abutting alignment with the main portions of the arms 81 and 82 by securement to the block 256 of the fine adjustment device with bolts 300, and are further retained on the support arms 101 by the bolt 248 at the forward end of the support arm 101.

Figure 12:
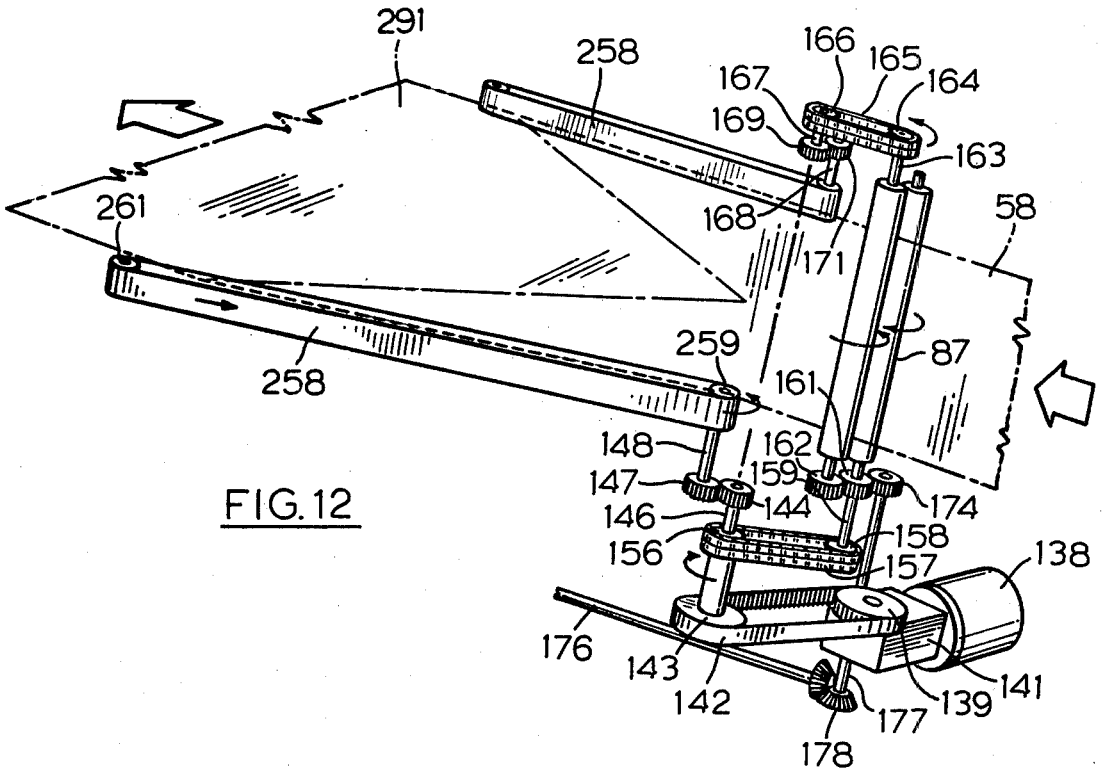
FIG. 12 shows in more detail the drive mechanism for the web-conveying endless belts of the machine of FIG. 11.
Figure 13:
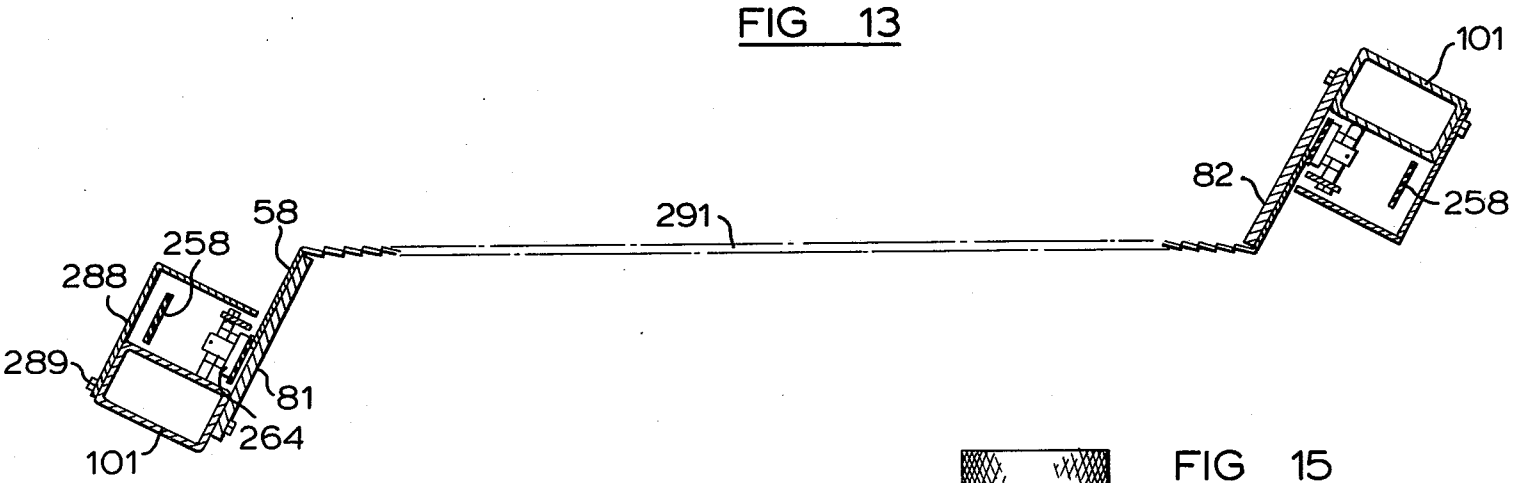
FIG. 13 shows a cross-section through the expander arms taken on the line 13—13 of FIG. 11.

Referring now to FIG. 12, the drive mechanism for the belts 258 and rollers 87 is shown. Except as noted below this is similar to the previously-described arrangement illustrated in FIG. 3. The shaft 146 in this instance is journalled in a bracket 291 on the outer side of the side plate 89. The gear 144 meshes with the spur gear 147 on a parallel shaft 148 journalled in the support arm 101 which turns the pulley 259 driving the belt 258. The sprocket 164 is coupled through chain 165, to a sprocket wheel 166 connected on a shaft 167 journalled in a bracket 292 on the outer side of one side plate 210. The shafts 146 and 167 are coaxial with one another and with the dowel pins 246 about which the expander arms 81 and 82 swing, so that when the angle of the expander arms is adjusted, the gear 147 and 171 rock around the gears 144 and 169, respectively, without losing driving engagement.

The operation of the machine, is generally as described in connection with the embodiment of FIGS. 1 to 10, but the guide plate 228 should initially be in open position and the rollers 87 in separated position until after the web has its edges are gripped between the belts and the arms. The guide plate 228 and the rollers 87 are then restored to the closed position so that in subsequent running of the machine, the rollers 87 feed the web forwardly and the plates 227 and 228 smooth out the feed of the web and will deliver it directly to the expander arms 81 and 82 in alignment with the rear edges of the arms. The spacing between the plates 227 and 228 is selected so that with the thickness of web 58 to be employed, the web 58 can run freely between the plates yet will be positively guided without opportunity for misalignment. The expansion then follows in the same manner as described previously in connection with the machine of FIGS. 1 to 10. With the present arrangement, it will be noted that adjustment of the portion of the arms 81 and 82 noted previously, in order to obtain uniformly sized and orientated diamond shaped meshes, can be carried out using the fine adjustment member 251.

The degree of lateral expansion of the web, i.e. the increase in the width of the expanded web as compared with the original web can be varied by swinging the expander arms 81 and 82 towards or away from one another about the pivotal axes of the dowel pins 246.

The expander machine of FIGS. 11 to 19 can accommodate input webs of varying widths, and the permissible range of variation of the width is approximately twice the transverse width of the belts 258 which are employed. Within these limits, the edges of the web can be gripped between the area of overlap between the belts 258 and the expander arms 81 and 82.

The form shown in the drawings, in which belts 258 are supported so as to extend beyond the inner inclining edges of the expander arms 81 and 82 at the front end is especially advantageous since it allows the web to be expanded across its full width without leaving any unexpanded selvedge and without deforming the edges of the web out of the general plane of the unexpanded product. As can be seen in FIG. 16, towards the forward end of the expander arms, the belt 258 extends inwardly beyond the inner inclining edges of the expander arms. It has been found that in practice this does not interfere with the free expansion of the web, since as can be seen in FIG. 16, the expanded material 291 slopes sharply away from the belt 258 at the point where it slips over the edge of the expander arm 81. Forwardly of the region shown in FIG. 16, the edge portions of the web 58 slips over the inclining inner edges of the arms 81 and 82, and it is found that with the appropriate angled orientation between the inner edges of the arms 81 and 82 and the slits in the web 58, as explained above with reference to FIG. 3, the edge portions of the web 58 are expanded to the same desired extent as the intervening parts of the web which have been expanded before the web reaches the forward end of the machine.

When producing expanded webs for use as explosion-suppressive fillings in fuel containers, we prefer to employ metal, e.g. aluminium alloy foils of thickness of from 0.0005 to 0.012 inches. In order to obtain optimum explosion-suppressive properties, it is preferable to employ meshes with certain selected mesh dimensions. Preferably the expanded mesh has a longest width dimension, that is the distance between the longitudinal extremities of longitudinally adjacent meshes (the distance A-A in FIG. 3) of from $\frac{1}{8}$ to $1\frac{1}{4}$ inches; a short width dimension, that is the distance measured between the centres of laterally opposing connection portions (the distance between the centres of the connection portions 292 and 293) of from one-sixteenth to five-eighths of an inch, and a strand width (the dimension B-B) of from one thirty-secondths to seven thirty-secondths of an inch.

We prefer to expand the lateral dimension of the foil by about 284% in the direction extending transversely to the slit lines. As a result of this expansion the foil contracts in the direction extending longitudinally of the slit lines to about 87% of its original dimension.

Merely by way of example, it can be mentioned that with the above degree of expansion, a piece of foil originally $14\frac{1}{4} \times 12$ inches (area 171 sq. inches) would expand to $40\frac{1}{2} \times 10\frac{1}{2}$ inches (area 425 sq. inches). This represents an area expansion of 248%.

For use as an explosion-suppressive filler, the expanded mesh produced is laid in superimposed layers to form a bale which is then employed as a filler mass occupying the internal space within a fuel container.

The bale may be formed by, for example, winding the expanded mesh up into a cylindrical coil, folding it, or severing the web into uniform pieces which are then stacked one on top of the other.

We claim:

1. A machine for expanding metal webs comprising a pair of expander arms having vertically and horizontally diverging edges for passing a slit metal web therealong for opening the slits in the web out into diamond-shaped meshes, the arms being supported on a sub-frame by adjustable connecting means allowing the angle between the edges of the arms to be widened or diminished, and the sub-frame being mounted on a main frame through second adjustable connecting means allowing the sub-frame to be tilted about a pivotal axis extending longitudinally of the direction of web feed along the arms.

2. A machine according to claim 1 having the pivotal axis extending centrally of the web feed along the arms.

3. A machine as claimed in claim 1 in which the arms comprise flat, smooth-surfaced triangular plates each supported for pivoting about a transverse axis extending transverse to the said longitudinal pivotal axis.

4. A machine as claimed in claim 3 in which the web is gripped by a gripping and conveying device along an outer edge of each plate.

5. A machine as claimed in claim 4 in which the gripping device is a driven endless belt having a longitudinal groove and a driven endless blade member parallel to and pressing edgewise into the groove, the web edges being gripped in the groove between the belt and the blade member.

6. A machine as claimed in claim 4 in which the gripping device comprises a driven endless belt which runs along the expander arm and is pressed towards the smooth surface thereof and grips the metal web between the belt and the smooth surface.

7. A machine as claimed in claim 4 in which each plate can be adjusted to a limited extent by pivoting it in its own plane.

8. A machine as claimed in claim 1 including supporting structure for rotatably mounting a coil of slit metal web material and guide means between the coil-supporting structure and the expander arms for feeding the slit web directly to the arms.

9. A machine as claimed in claim 8 including a smooth bar non-rotatably supported between the coil-supporting structure and the expander arms and inclined non-perpendicularly to the direction of web feed along the expander arms, and wherein the feed web slips around the bar and is thereby directed from a transverse to a longitudinal direction of travel.

10. A machine as claimed in claim 9 having the bar aligned with the general plane of the web at the region of approach to the expander arms.

11. A machine as claimed in claim 8 in which the coil-supporting structure is normally connected to the main frame of the machine by releasable connecting means.

12. A machine for expanding metal webs comprising a pair of expander arms with vertically and horizontally diverging edges, each arm having a gripper for retaining the edge of a web and conveying the web along the arms, each gripper comprising a driven endless belt extending around a first pair of pulleys having parallel axes, said belt having an outer planar surface provided with an endless longitudinal groove and a driven endless ribbon-form blade member extending around a second pair of pulleys having their axes at right angles to said first pulleys, said blade member having a continuous lateral blade edge pressing edgewise into the groove, the web edge being gripped in the groove between the belt and the blade member.

13. A machine as claimed in claim 12 including frame means, means mounting the expander arms for transverse sliding on the frame means, and including adjusting means whereby the transverse spacing of the arms can be adjusted.

14. A machine for expanding metal webs comprising a pair of expander arms with vertically and horizontally diverging edges for passing a slit web forwardly therealong and for spreading the web therebetween so as to open out the slits in the web into diamond-shaped meshes, the surface of each expander arm on which the web is supported and over which the web slips being smooth-surfaced at least in a region extending forwardly from the rear of the arm and over a major part of its length, and the web being conveyed by being gripped at each edge between the smooth surface of the expander arm and a driven endless belt which runs along the expander arm said belt being a resilient composite belt having a continuous endless outer facing layer of soft resilient material, and a continuous, endless inner wear layer of wear-resistant material, said belt extending around a pair of pulleys having their axes parallel to the smooth surface of the expander arm, at least one pulley being adjustable longitudinally to maintain a pre-determined tension in the belt, and the belt being pressed towards the smooth surface of the expander arm by pressing members pressing direct on the inner surface of the wear-resistant layer.

15. A machine as claimed in claim 14 wherein the belt extends beyond the diverging edge of each expander arm at a forward region of the arm where the surface of said arm is formed with longitudinal grooves for engaging frictionally with the web.

16. A machine as claimed in claim 15 wherein the grooves are of saw-tooth section.

17. A machine as claimed in claim 14 which said smooth surface of each expander arm is coated with a low-friction plastics coating.

18. A machine for expanding metal webs comprising a pair of expander arms with vertically and horizontally diverging edges, each arm having a gripper for retaining the edge of a web and conveying the web along the arms, each gripper comprising a driven endless belt having a longitudinal groove and a driven endless blade member parallel to and pressing edgewise into the groove, the web edge being gripped in the groove between the belt and the blade member, and means adjustably mounting at least one of the endless members for varying the length for which said member presses against the other endless member.

* * * * *